United States Patent [19]

Hosoya

[11] Patent Number: 4,688,826

[45] Date of Patent: Aug. 25, 1987

[54] FOLDED SHIPPING FORM

[75] Inventor: Tomohisa Hosoya, Tokyo, Japan

[73] Assignees: Sun Pack Co., Ltd.; Minami Seiki Co., Ltd., both of Tokyo, Japan

[21] Appl. No.: 866,808

[22] Filed: May 27, 1986

[30] Foreign Application Priority Data

Mar. 5, 1986 [JP] Japan ..... 61-31564[U]

[51] Int. Cl.[4] ..... B42D 15/00; B42D 3/10; G09F 3/00; G09F 3/08

[52] U.S. Cl. ..... 283/79; 283/78; 40/306; 40/312

[58] Field of Search ..... 283/69, 58, 79, 80, 283/81, 103, 105, 78; 281/2, 5; 40/306, 310, 312

[56] References Cited

U.S. PATENT DOCUMENTS

| | | | |
|---|---|---|---|
| 1,028,684 | 6/1912 | Daly | 283/79 |
| 2,500,612 | 3/1950 | Krogh | 283/78 |
| 3,695,422 | 10/1972 | Tripodi | 40/312 |
| 4,323,608 | 4/1982 | Denny et al. | 40/306 |
| 4,407,524 | 10/1983 | Trautlein | 283/79 |
| 4,592,572 | 6/1986 | Instance | 283/79 |

*Primary Examiner*—Donald R. Schran
*Assistant Examiner*—Paul M. Heyrana, Sr.
*Attorney, Agent, or Firm*—David H. Semmes; Warren E. Olsen

[57] ABSTRACT

This invention is concerned with a folded shipping form characterized in that a sheet form which is oblong, folded from the flap portion and narrower in width than that of a transparent film having a layer of pressure sensitive adhesive at the back surface, is inserted between the transparent film and a release paper affixed to the layer of pressure sensitive adhesive releasably, the upper portion of the above folded form is affixed to the layer of pressure sensitive adhesive of the transparent film to the folded portion and the folded portion of the form is provided so as to be able to draw out.

3 Claims, 2 Drawing Figures

FOLDED SHIPPING FORM

BACKGROUND OF THE INVENTION (1) Field of the Invention

This invention relates to a shipping form which is used as a shipping label for a parcel imprinted by a line printer or an impact printer, but also to a shipping form upon which it is possible to print shipping information, especially, with a laser or a non-impact printer.

(2) Description of the Prior Art

Heretofore, the shipping form generally comprised a multiple copy form as one set with a bottom paper including a tack sheet affixed as a shipping label to a shipped material. In such case the shipping information and the like are described in a plurality of shipping forms. A continuous sheet form is subjected to an impact printer which imprints the shipping information, then cut one set at a time and affixed to the shipped material.

At present, since the non-impact printer or the laser printer which enables a high velocity printing has been developed and the treatment capacity thereof is also excellent, many non-impact printers or laser printers have been used for large amounts of printing. Thus, the demand for using such printers for the description of information on shipping forms has increased.

However, since the non-impact printer or the laser printer prints only one sheet form, it is impossible to use it for conventional copy forms. Accordingly, there exists the problem of being restricted to only one sheet form and of being difficult to affix the tack sheet or shipping label.

SUMMARY OF THE INVENTION

The object of this invention is to eliminate the above problems and to provide a shipping form which may be affixed as a shipping label to a parcel and printed with a non-impact printer or a laser printer, thereby enabling the printing of a large amount of shipping forms, a prompt affixing of the shipping label to a parcel and a protection of the shipping label form.

This invention which eliminates the above described problems, comprises a folded shipping form characterized by inserting a sheet at which is oblong, folded at its flap portion and which is narrower in width than that of a transparent film which has a layer of pressure sensitive adhesive at the back surface. The shipping form is folded between said transparent film and a release paper releasably affixed to said layer of pressure sensitive adhesive. The upper portion of the folded form is affixed as a shipping label to the layer of pressure sensitive adhesive. The remaining folded portion of the form may be drawn out and removed.

DETAILED DESCRIPTION OF THE INVENTION

Figure 1:
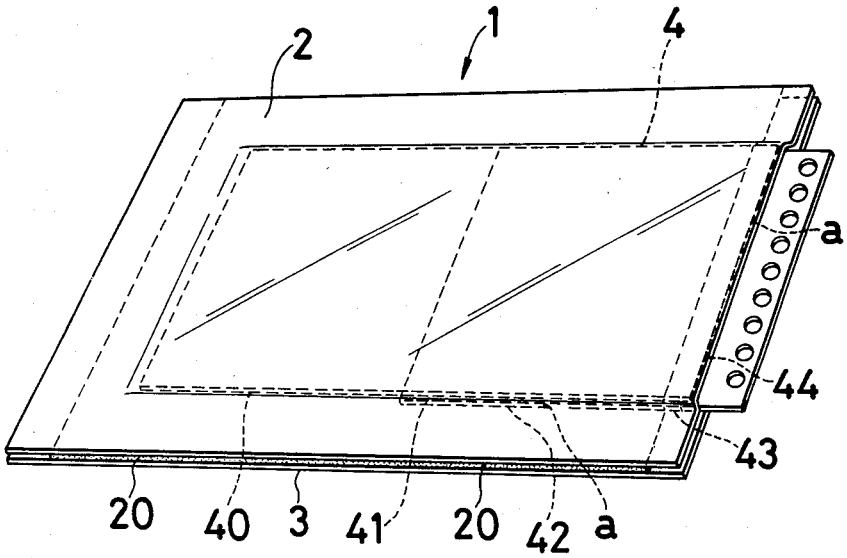
FIG. 1 is a perspective view which shows the shipping form according to this invention.
Figure 2:
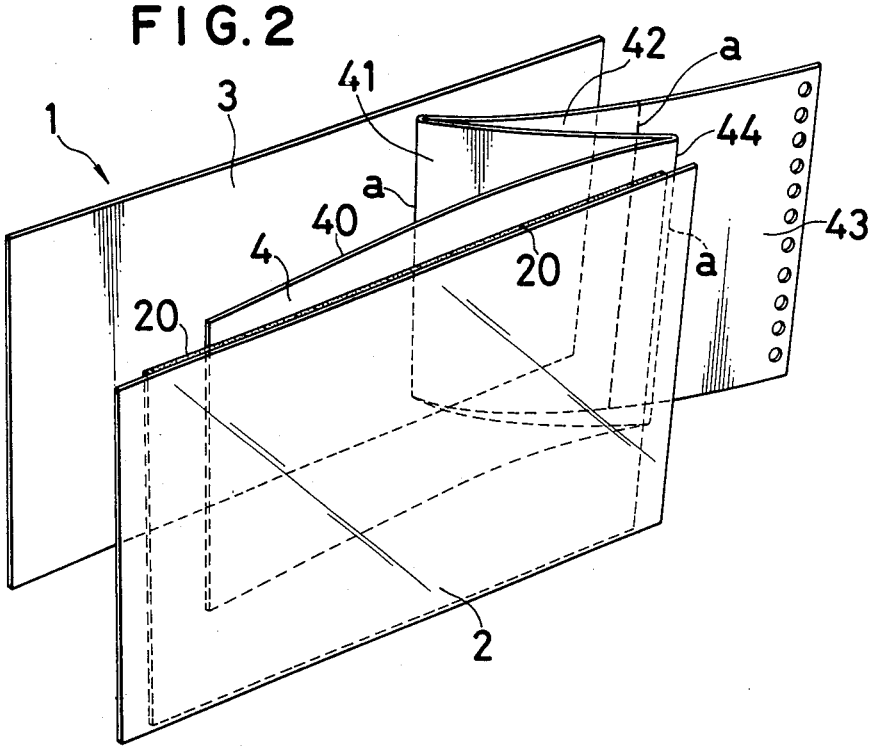
FIG. 2 is an exploded view.

The figures illustrate a folded shipping form 15 including shipping label 4 which can be affixed to the shipped material. Said shipping form 1 consists also, of a transparent film 2 having a layer of pressure sensitive adhesive 20 at the back surface thereof, a release paper 3 affixed releasably to said layer of the pressure sensitive adhesive 20 and sheet form 4 which is inserted between said transparent film 2 and the release paper 3.

Multiple sheet form 4, for instance, may include an affixed shipping label 40, a carrier agent bill 41, a receipt 42 and a paying-in slip or bill 43 which are continuously provided in a lateral direction. Form 4 is narrower in width and longer transversely (oblong) than transparent film 2. Shipping information is printed on each form previously with a non-impact printer or a laser printer. Said form 4 is folded in a Z shape from a flap portion 44 extending between the affixed shipping label 40 and the carrier agent bill 41 with the affixed shipping label 40 on top so as to be being affixed to the layer of the pressure sensitive adhesive 20 adjacent the transparent film 2.

When the shipping label 40 is affixed to the shipped material, the transparent film 2 may be affixed after exposing the layer of the pressure sensitive adhesive 20 by releasing release paper 3. The margin of the form 4 is drawn out to take out the folded carrier agent bill 41, receipt 42 and paying-in slip or bill 43, thereby being able to cut them from the perforations a as necessary.

As described above, in the shipping form according to this invention, a multiple sheet form is folded and inserted between a transparent film having a layer of pressure sensitive adhesive at the back surface thereof and a release paper, with the upper portion of the shipping label being affixed to the layer of pressure sensitive adhesive. Accordingly, shipping information may be imprinted with a non-impact printer or laser printer before the form is folded, which enables a large amount of printing. Further, shipping management information, such as OCR or the bar code, may be imprinted, also due to the possibility of using the non-impact and laser printer, thereby being able to enhance the shipping. Since the sheet form wherein the information printing is imprinted with the non-impact or laser printer is folded into three, form has the same function as the conventional copy form wherein 3 or 4 sheet forms are made as one set, and can be affixed simply to the material being shipped. Further, it is possible to protect the inner form with film, thereby providing an excellent practical effect.

What is claimed is:

1. A folded shipping form comprising:

(i) a transparent film;

(ii) an adhesive film secured to a back surface of said transparent film;

(iii) a release paper releasably secured to said adhesive film; and (iv) a sheet form that is vertically is narrower and laterally is longer than corresponding dimensions of said transparent film and is removably interposed between said adhesive back surface of said transparent film and said release paper, said sheet form further comprising a plurality of laterally extending portions folded vertically so as to overlap wherein at least one portion is separable at a vertical perforation and a first portion having a front surface adapted to be secured against said adhesive film, thereby to function as a shipping label, and at least one adjacent, folded portion is adapted to be drawn out laterally from behind said transparent film and separated, thereby to define a removable receipt.

2. A folded shipping form as in claim 1, wherein said plurality of folded portions comprises at least three portions, that laterally are folded into a Z-shape, wherein the leading edge of the third portion extends outward beyond the lateral dimension of said transparent film, so as to facilitate a drawing out of the second and third portions, while said first portion remains adhered to said transparent film.

3. A folded shipping form according to claim 2, wherein said sheet form further comprises at least one vertical perforation, where all or part of a folded portion of the sheet form can be removed to define a detachable shipping element, such as carrier agent bill or a paying in slip.

* * * * *